US006179377B1

(12) United States Patent
Harper

(10) Patent No.: US 6,179,377 B1
(45) Date of Patent: Jan. 30, 2001

(54) HIGH CHAIR WITH MAGNETIC DISHES AND TRAY

(76) Inventor: Joseph A. Harper, 36 Harper Rd., West Monroe, NY (US) 13167

( * ) Notice: Under 35 U.S.C. 154(b), the term of this patent shall be extended for 0 days.

(21) Appl. No.: 09/356,654

(22) Filed: Jul. 19, 1999

(51) Int. Cl.[7] ..... A47B 39/00
(52) U.S. Cl. ..... 297/148; 297/135
(58) Field of Search ..... 424/128, 168, 424/432, 134; 297/135, 148, 153, 149, 217.1

(56) References Cited

U.S. PATENT DOCUMENTS

| | | | |
|---|---|---|---|
| D. 355,827 | 2/1995 | Liu | D8/71 |
| 3,143,374 | 8/1964 | Carboni | 297/188 |
| 3,508,183 | 4/1970 | Pinckard | 335/303 |
| 3,610,459 | 10/1971 | Hanson | 220/23.83 |
| 5,405,004 | 4/1995 | Vest et al. | 206/350 |
| 5,975,628 * | 11/1999 | Russell . | |

* cited by examiner

*Primary Examiner*—Milton Nelson, Jr.
(74) *Attorney, Agent, or Firm*—Bernhard P. Molldrem, Jr.

(57) ABSTRACT

A high chair has a tray that has a steel (ferromagnetic) core or insert layer sandwiched between durable plastic layers, to be used with children's dishware that has permanent magnets in their bases or bottoms. The insert can be a sheet of seven-gauge steel, with perforations to relieve some of the weight of the metal. The bottoms may incorporate two or more coin-shaped permanent magnets.

9 Claims, 2 Drawing Sheets

HIGH CHAIR WITH MAGNETIC DISHES AND TRAY

BACKGROUND OF THE INVENTION

This invention relates to high chairs and seats for feeding infants, and is more particularly directed to an improvement in a high chair relating to prevention of spills and overturning dishes on the high chair tray.

At mealtimes, infants and small children are often placed in a high chair to be fed. The child may be strapped of into the seat portion, and then the high chair tray is attached in front of the child. The tray usually has a raised rim or flange around its circumference to form a recessed main tray area, with the rim keeping spilled food and liquid from running off onto the floor.

One main problem has been that small children may grab a bowl or dish of food, and then dump or fling the food onto the floor, or else may hit or knock against the dishes to push them off the tray. One attempt to control this has been to use dishes and cups that have vacuum or suction cups on their bases, so that the suction cups will hold the dishes on the high chair tray. Unfortunately, the vacuum does not hold for long on these, and after a short while the dishes come loose and the child can knock them off the tray. Also, the soft rubber material of the suction cup can wear out, especially if the dishes are washed at high temperatures in an automatic dishwasher. An alternative technique is a feeding tray that snaps onto the rim of the main high chair tray. An example of this is described in U.S. Pat. No. 3,143,374. However, these are rather cumbersome and are difficult for the parent to place on the tray and remove during a meal. To date, no one has proposed a system of high chair, tray, and dishes that are simple for the parents to use in feeding their child, but which avoid the problems that come from the child knocking against the dishes or trying to pick them up. Also, no one has proposed a system that uses dishware that is durable, stays on the tray, can be machine washed without damage to it, and is as functional as children's conventional dishware.

OBJECTS AND SUMMARY OF THE INVENTION

Accordingly, it is an object of the present invention to provide a system of a high chair, tray, and stay-on-tray children's dishes, that avoids the drawbacks of the prior art.

It is another object to provide a high chair tray that accommodates magnet-footed dishware, and which is durable and relatively light weight.

It is a more specific object to provide a high chair tray or tray table together with children's dishes, which stay put on the tray during the child's meal, and resist being picked up and emptied onto the floor by the child, or being knocked off the tray.

In accordance with one aspect of the present invention, a high chair for feeding infants or young children has associated stay-on-tray children's dishware. The high chair has a child seat is provided with a tray member supported over the child seat. The tray is formed of a durable plastic resin material and raised peripheral rim that defines a supporting surface for holding the children's dishware during the meal. Here, the high chair incorporates an improvement wherein the tray member includes a ferromagnetic sheet insert molded within said plastic resin material and which is substantially co-extensive with the supporting surface. The children's dishware, i.e., at least one children's dish, has a permanent magnet incorporated into its base or bottom to attach magnetically to the tray member. The permanent magnet holds the dish firmly down on the tray. The dish will not move or tip over when bumped, and will not leave the tray when struck or knocked. To lift the dish off the tray, the child's parent can tilt the dish slightly so that the magnet is lifted off the tray, and then the dish can be lifted up.

In a preferred embodiment, the insert can be a sheet of about seven-gauge steel, and can have an array holes drilled or punched through it, for example, ⅜ inch round holes. This relieves some of the weight of the steel insert, but does not affect the magnetic properties. The dishes can have a permanent magnet that is coextensive with the base or bottom of the dish, or else can have a number of coin- or medallion-size permanent magnets incorporated into the base.

The above and many other objects, features, and advantages of this invention will be more fully appreciated from the ensuing description of a preferred embodiment, which is to be read in conjunction with the accompanying Drawing.

DETAILED DESCRIPTION OF THE PREFERRED EMBODIMENT

Figure 1:
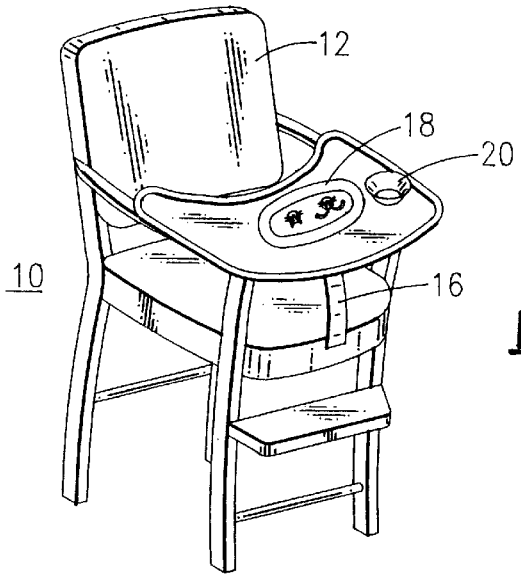
FIG. 1 is a perspective view of high chair assembly, as set up for use, according to an embodiment of the present invention.

With reference now to the Drawing, FIG. 1 shows a high chair 10 which is of generally conventional design, with a seat portion 12 adapted to an infant or small child, and a tray portion 14 that is supported, e.g., on arm rails of the seat portion 12. A strap 16 can be used to keep the child from slipping out of the seat. Here there is shown a plate or similar dish 18 and a bowl 20 on the tray portion 14. The plate 18 and bowl 20 have permanent magnet bases according to the invention. A drinking cup, not shown here, may be provided either with or without the magnetic footing.

Figure 2:
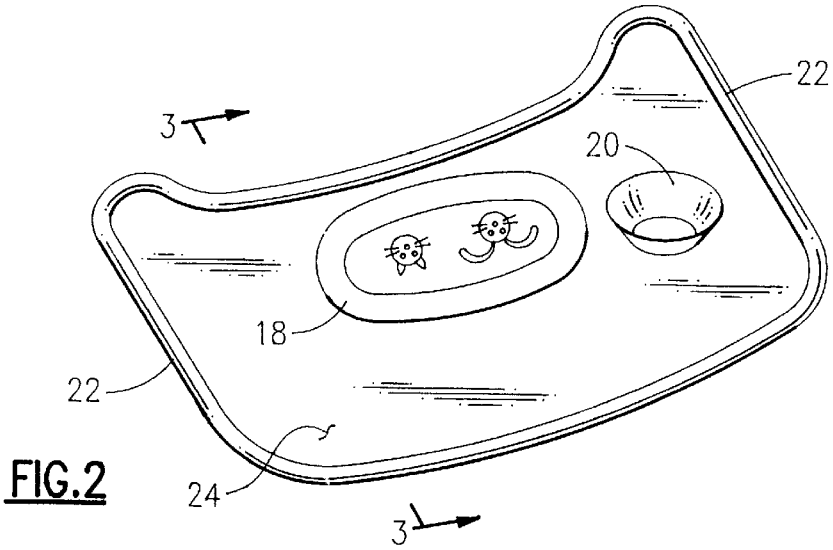
FIG. 2 is an enlarged perspective view of the high chair tray of this embodiment.
Figure 3:
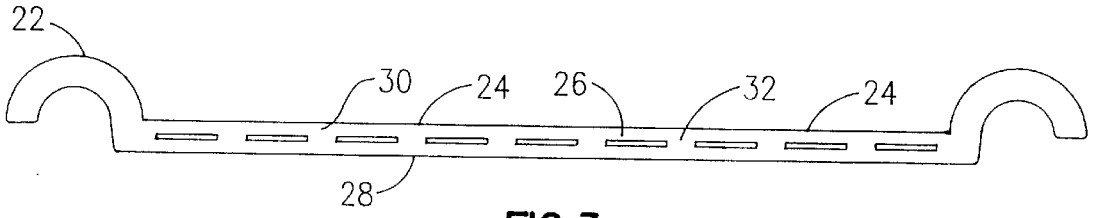
FIG. 3 is a cross section taken at 3—3 of FIG. 2.
Figure 4:
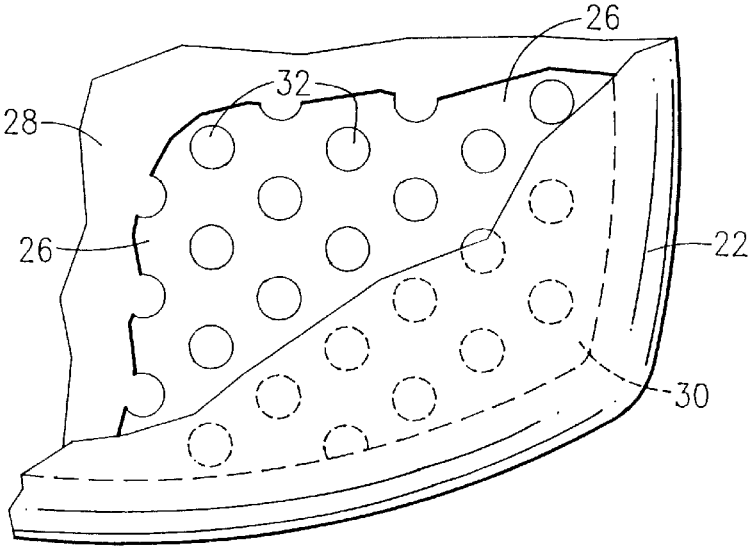
FIG. 4 is a broken plan view of a portion of the tray of this embodiment.

As shown in more detail in FIG. 2, the tray 14 has a raised peripheral rim 22, leaving a central recessed main part 24 of the tray portion that serves as the main support surface for the dishware and other items for the child's meal. As shown in cross section in FIG. 3, the tray has an insert 26 in the form of a perforated steel sheet that is buried between layers of plastic in the tray 14. Favorably, the insert 26 is molded in place in the plastic tray portion 14. The insert 26 extends to the rim 22 and is coextensive with the main part 24 of the tray. As seen in the broken plan view of FIG. 4, the insert is covered by a lower layer 28 of a durable plastic synthetic resin, and by a thin upper layer 30 of the same or another plastic resin. The insert 26 is favorably a sheet of steel, e.g., seven gauge or three-sixteenths-inch thick, and should be a strongly magnetizable steel so that it will hold the magnetic dishware onto the tray 14. The holes or perforations 32 can be, for example, about ⅜ inch in diameter, and are either drilled or punched in the sheet material. The array of holes 32 relieves a significant fraction of the weight of the metal insert, so that the high chair tray 14 can be relatively light weight. The holes 32 do not interfere with the magnetic attachment of the dishes 18, 20 to the tray 14.

Figure 5:
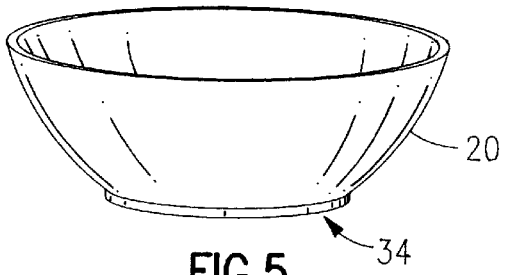
FIG. 5 is a perspective view of a children's dish employed in this embodiment.
Figure 6:
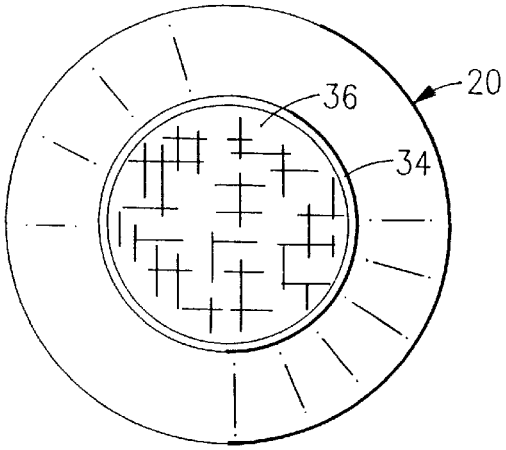
FIG. 6 is a bottom view of the dish of FIG. 5.
Figure 7:
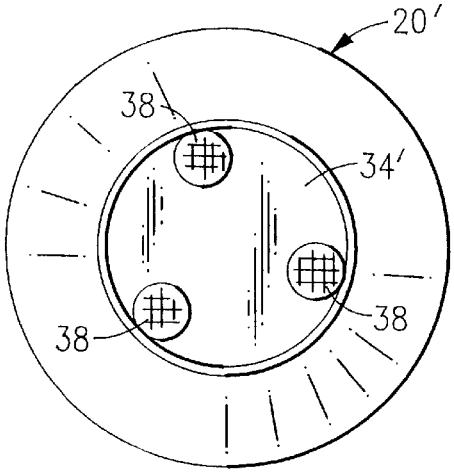
FIG. 7 is a bottom view of an alternative embodiment of the dish of FIG. 5.

As shown in FIGS. 5 and 6, the bowl 20 that is provided with this invention has a base or bottom 23 that is basically flat or flush, and is provided without the bottom flange or ring. A permanent magnet 36, formed of a suitable magnetic material, spans the entire bottom 34 and is coextensive with the base or bottom. As an alternative, as shown in FIG. 7, a bowl 20' of this invention can have a plurality of coin-sized flat disk magnets molded into the base 34' of the bowl 20'. Here, three disk magnets 34' are shown, but more or fewer could be employed. The magnet 38 or magnets 38' sit flush onto the top of the tray portion. Another embodiment, not shown, could incorporate strip or bar magnets into the base of an elongated plate or other dish. These can be molded directly into the base or bottom of the dish, which can be a plate, saucer, bowl, cup, or mug. Preferably, a durable plastic can be used for the dishware, but the dishware could also be made, at least partly, of aluminum or another material.

Instead of sheet steel, another ferromagnetic material could be used for the tray insert 26. Also, the perforations 32 do not need to be round, as shown, but may be square, or oblong.

While the invention has been described with reference to specific preferred embodiments, the invention is certainly not limited to those precise embodiments. Rather, many modifications and variations will become apparent to persons of skill in the art without departure from the scope and spirit of this invention, as defined in the appended claims.

I claim:

1. In a high chair for feeding of young children, with associated children's dishware, in which a child seat is provided with a tray member supported over said child seat, said tray member being formed of a durable plastic resin material and defining a supporting surface for holding the children's dishware; the improvement wherein said tray member includes a ferromagnetic sheet insert within said plastic resin material and substantially co-extensive with said supporting surface; and wherein said dishware includes at least one children's dish having a permanent magnet incorporated into a bottom thereof to attach magnetically to said tray member, said ferromagnetic sheet insert including means relieving a significant fraction of the weight of said sheet insert without adversely affecting its magnetic properties.

2. The high chair of claim 1, wherein said insert is a sheet of steel of a nominal 7 gauge.

3. The high chair of claim 1, wherein said insert is a sheet of steel of 3/32 inch thickness.

4. The high chair of claim 1, wherein the permanent magnet in said children's dish is coextensive with the bottom of said dish.

5. The high chair of claim 1, wherein the bottom of said children's dish is flat and without a bottom rim.

6. In a high chair for feeding of young children, with associated children's dishware, in which a child seat is provided with a tray member supported over said child seat, said tray member being formed of a durable plastic resin material and defining a supporting surface for holding the children's dishware; the improvement wherein said tray member includes a ferromagnetic sheet insert within said plastic resin material and substantially co-extensive with said supporting surface; and wherein said dishware includes at least one children's dish having a permanent magnet incorporated into a bottom thereof to attach magnetically to said tray member, wherein the permanent magnet in said children's dish includes a plurality of coin-size flat magnets incorporated into said bottom.

7. In a high chair for feeding of young children, with associated children's dishware, in which a child seat is provided with a tray member supported over said child seat, said tray member being formed of a durable plastic resin material and defining a supporting surface for holding the children's dishware; the improvement wherein said tray member includes a ferromagnetic sheet insert within said plastic resin material and substantially co-extensive with said supporting surface; and wherein said dishware includes at least one children's dish having a permanent magnet incorporated into a bottom thereof to attach magnetically to said tray member, wherein said insert is a sheet of steel having an array of holes formed therein.

8. The high chair of claim 7, wherein said holes are uniformly distributed over said insert.

9. The high chair of claim 7, wherein said holes are about 3/8 inch in diameter.

* * * * *